United States Patent [19]

Ro et al.

[11] 4,331,478

[45] May 25, 1982

[54] CORROSION-RESISTANT STAINLESS STEEL POWDER AND COMPACTS MADE THEREFROM

[75] Inventors: David H. Ro, Cleveland Heights; Erhard Klar, Beachwood; Charles I. Whitman, Bay Village, all of Ohio

[73] Assignee: SCM Corporation, New York, N.Y.

[21] Appl. No.: 161,551

[22] Filed: Jun. 20, 1980

Related U.S. Application Data

[63] Continuation-in-part of Ser. No. 10,956, Feb. 9, 1979, Pat. No. 4,240,831.

[51] Int. Cl.[3] ..... B22F 3/00

[52] U.S. Cl. ..... 75/228; 75/0.5 C; 75/200; 75/211; 75/224; 75/251

[58] Field of Search ..... 75/0.5 BA, 0.5 C, 200, 75/211, 224, 228, 251

[56] References Cited

U.S. PATENT DOCUMENTS

| | | | |
|---|---|---|---|
| 2,956,304 | 10/1960 | Batten et al. | 75/0.5 C |
| 3,243,288 | 3/1966 | Feldmann et al. | 75/0.5 BA |
| 4,154,608 | 5/1979 | Carey et al. | 75/0.5 BA |
| 4,240,831 | 12/1980 | Ro et al. | 75/0.5 BA |

FOREIGN PATENT DOCUMENTS

| | | | |
|---|---|---|---|
| 52-35708 | 3/1977 | Japan | 75/0.5 BA |

*Primary Examiner*—Mark Bell

*Attorney, Agent, or Firm*—Robert A. Sturges; Merton H. Douthitt

[57] ABSTRACT

The corrosion resistance of atomized tin-and-carbon containing stainless steel powders and compacts thereof is enhanced by incorporating a modifier metal into the melt prior to atomization. Effective modifier metals disclosed are niobium, titanium, tantalum, molybdenum, and the like.

9 Claims, No Drawings

CORROSION-RESISTANT STAINLESS STEEL POWDER AND COMPACTS MADE THEREFROM

This is a continuation-in-part of copending application Ser. No. 010,956 filed Feb. 9, 1979, now U.S. Pat. No. 4,240,831 dated Dec. 23, 1980.

BACKGROUND OF THE INVENTION

The present invention relates to powder metallurgy (P/M) stainless steel powders and compacts therefrom, and more particularly to improving the corrosion resistance of such powders and compacts.

Heretofore, poor corrosion resistance of such compacts has been attributed mainly to the porosity found within the compacts, thus most techniques for overcoming corrosion problems have been aimed at closing the porosity. Prior techniques aimed at minimizing the surface porosity of the compacts made from such stainless steel powders include mechanical closure treatment, plastic impregnation, surface coatings, or passivation treatments. Each of these techniques has some limitation as to its effectiveness in addition to raising the cost of the final support product. Other proposals aimed at improving the corrosion resistance of stainless steel powder compacts concentrate on compacting and sintering parameters. These proposals generally state that the sintering conditions and sintering atmosphere have a marked influence on the corrosion properties of the powder compacts; however, most of the experimental results reported in these proposals are inconsistent. Japanese Tokkai No. 35708 (1977) suggests that a small proportion of tin can be added to some stainless steel powder compacts to enhance the corrosion resistance. However, great care must be taken in preparing compacts according to the Japanese specification because the carbon content of the compacts must be maintained at less than 0.05%. Higher carbon levels in the parent alloy and carbon pickup during processing must be avoided according to the Japanese specification in order to maintain corrosion resistance of the compacts made.

In accord with the present invention, it has now been found that tin containing stainless steel powder and compacts thereof having greater than 0.05% carbon and excellent corrosion resistance can be produced if an additional modifier metal selected from the group consisting of niobium, titanium, tantalum, molybdenum, and the like is alloyed with the parent alloy during the powder formation.

It is an object, therefore, of the present invention to add a modifier metal selected from the group consisting of niobium, titanium, tantalum, molybdenum, and the like and mixtures thereof to a tin containing stainless steel powder or compact thereof having greater than 0.05% carbon. A further object and advantage of the present invention is to produce the stainless steel powder or compact thereof having superior corrosion resistance when compared to similar high carbon powders and compacts which do not contain the modifier metal. A still further object and advantage of the present invention is that corrosion resistant stainless steel powder compacts can be produced without the heretofore required rigid controls on carbon content and pickup. Still further objects and advantages will become more evident from the detailed description of the invention.

SUMMARY OF THE INVENTION

The present invention is a process for improving the corrosion resistance of an atomized tin containing stainless steel powder or compact thereof, said powder or compact having greater than 0.05% carbon. The process comprises adding an effective proportion of a modifier metal selected from the group consisting of niobium, titanium, tantalum, molybdenum, and the like and mixtures thereof to the alloy melt prior to atomization. The proportion of modifier metal added being effective to enhance the corrosion resistance of said stainless steel powder or a compact thereof.

DETAILED DESCRIPTION OF THE INVENTION

The present invention is applicable to numerous types of stainless steel powders whether conventionally classified as ferritic, austenitic, or specialty steel powder. Major elements used in forming a stainless steel alloy powder are iron, chrominum, and nickel with a wide variety of minor alloy elements being present, some for achieving desired mechanical and/or physical properties of the ultimate sintered part made from the stainless steel powder and some from advantitious sources, e.g., as impurities, and the like. Reference is made to the AISI series of stainless steel grades for amplification on the particular elements comprising various stainless steel alloys suitably formulated into "powder metallurgy" (P/M) stainless steel powders.

Tin has been added to a limited number of stainless steel alloys to enhance corrosion resistance; however, the alloys for which a tin addition was effective and the processing parameters which could be employed to make compacts from such powder were severely limited because the carbon content had to be maintained below 0.05% in order for the corrosion resistance of the resulting part to be enhanced.

Alloys of the present invention are tin containing stainless steel powder metallurgy alloys. The tin content of these metal powders can be from about 0.01 to about 10%, advantageously about 0.05 to about 5%, and preferably about 0.5 to about 3%. Optionally, the alloys can further contain a small proportion of copper, i.e., up to about 5% in addition to conventional stainless steel alloy components. The copper present will improve the compressibility of the powder into a sintered compact and in some circumstances further enhance the corrosion resistance of tin containing stainless steel powders.

The present alloys and compacts thereof further contain greater than about 0.05% carbon. Carbon contents of this magnitude had heretofore caused a deterioration of the corrosion resistance of tin containing stainless steel powders and compacts thereof. The carbon can be present in the atomized powder or picked up during processing.

Alloys according to the present invention still further contain a modifier metal selected from the group consisting of niobium, titanium, tantalum, molybdenum, and the like and mixtures thereof. These modifier metal additions can be present in any effective amount for enhancing corrosion resistance of the stainless steel powder or compact thereof. Typically, the modifier metal is present in an amount from about 0.01 to about 10% and preferably is present in an amount from about 0.05 to about 5%.

Without being bound by theory, applicants believe that the modifier metal acts as a carbide stabilizer.

Therefore, it is believed that there is a specific ratio of modifier metal to carbon which provides the most effective alloy under the present invention. This ratio, however, is believed to be specific to the modifier metal and to vary from about 1:1 to about 10:1. In any event, the amount of modifier metal present will be within the ranges specified and within those ranges is believed to be effective for the present service.

The metal powder of the present invention is preferably manufactured by a water atomization process, though various gas atomization processes may be used. A water atomization process utilized jets of water to simultaneously break up and cool a stream of molten metal to form metal powder. Similarly a gas atomization process utilizes jets of a gas. U.S. Pat. No. 2,956,304 depict a typical water atomization apparatus and method for practice of this process. The stainless steel particle average size (weight average diameter) typically produced is less than 325 mesh though the distribution of particles ranges from finer than this on up to 100 mesh and larger (U.S. Standard Sieve Series).

Stainless steel powders are conventionally compacted for forming a wide variety of parts. Compacting by consolidation, unidirectional die, isostatic techniques, rolling techniques, vibratory techniques, optionally with extrusion, all are suitable for forming parts from the novel stainless steel powders of the present invention. Further on compacting techniques can be found in Kirk-Othmer, *Encyclopedia of Science Technology*, Vol. 16, 2nd Edition, pages 401–435, Interscience Publishers, New York, N.Y. (1968), the disclosure of which is expressely incorporated herein by reference. Densification from about 60% of theoretical on up to full dense parts is practiced conventionally and for the present invention. Typical compacts are made by consolidating under pressures of about 5–8 t/cm$^2$ producing compacts having from about 70–95% of theoretical density, and preferably about 80–84%.

Lubricants such as lithium stearate or zinc stearate are frequently used during compacting to increase the die life and decrease the pressure required to obtain the desired density. If a lubricant is used, it must be burned out before the sintering step. Burn-out at about 800° F.–1200° F. for about one-half hour is effective for this purpose.

Compacts of the stainless steel powder are sintered at high temperature under non-oxidizing atmospheres. Sintering temperatures of at least about 2300° F. and atmospheres having a dew point of lower than about −60° F. are preferred, but are extremely difficult and costly to achieve on a commercial scale. Effective sintering conditions for the present invention also include temperatures of about 2000°–2300° F. with dew points not much lower than about −40° F. Hydrogen gas is the preferred atmosphere for sintering, though on a commerical scale it is expensive and often dangerous at elevated temperatures. Accordingly, the present invention operates exceptionally using dissociated ammonia for the sintering atmosphere. Furthermore, vacuum sintering may be employed at temperatures of about 2100°–2500° F. Sintering times of about one-half hour to one hour are effective and typically used for this purpose. However, sintering times can be as high as two to three hours in some circumstances.

The following examples show ways in which the present invention has been practiced. In this application, all parts and percentages are by weight, all temperatures are in degrees Fahrenheit, and all of the units are in the metric system unless otherwise expressly indicated.

EXAMPLE 1

A modified 304L stainless steel powder containing 0.5% niobium, 1% tin, and 2% copper was produced by a conventional water atomization technique in a nitrogen atmosphere. This powder would substantially pass through a 100-mesh screen and further about 50% would pass through a 325-mesh screen. To simulate carbon pickup during processing a small amount of graphite was added to the atomized powder prior to compacting. The powder was compacted under pressure into specimens approximately 32×13×3 millimeters having a compressed density of about 6.5 g./cc. The compacted specimens were sintered in a dissociated ammonia atmosphere for 45 minutes at 2150° F. and had a carbon content of 0.054%.

The corrosion resistance of these sintered compacts was tested in accordance with ASTM D-117 specification. This is a salt spray test using a 5% salt solution as the spray medium. The samples were periodically inspected and notations were made when a sample showed 1% surface corrosion during the test. Data are shown in Table I.

EXAMPLE 2

Using the procedure of Example 1 a 304L alloy containing 1% tin and 2% copper only was prepared. Again, to simulate commercial carbon pickup, a small amount of graphite was added to the powder prior to pressing. The powder was pressed and sintered according to the procedure of Example 1, these specimens having a carbon content of 0.059%. Corrosion tests were performed in the same fashion as for Example 1, and data are shown in Table I.

TABLE I

| | Time In Salt Spray Until Samples Show 1% Surface Corrosion (Hours) | | |
|---|---|---|---|
| Compact Tested | 10% of Samples Show Corrosion | 20% of Samples Show Corrosion | 40% of Samples Show Corrosion |
| Example 1 (with niobium) | 35 | 45 | 65 |
| Example 2 (without niobium) | 15 | 21 | 36 |

It can be seen from FIG. 1 that the specimens modified according to the present invention are far superior to unmodified specimens; only about 10% of the modified specimens showing surface corrosion after 35 hours in salt spray where about 40% of the unmodified specimens show surface corrosion in this length of time. Other modifier metals disclosed in the present invention produce similar results, and, of course, mixtures or alloys of the modifier metals can be used in the present invention.

What is claimed is:

1. A process for improving the corrosion resistance of an atomized carbon and tin containing stainless steel powder or sintered compact thereof, said powder or compact thereof containing at least about 0.05% carbon, which comprises;

adding an effective proportion of a modifier metal selected from the group consisting of niobium, titanium, tantalum, and mixtures thereof to a metal of said stainless steel prior to atomizing, said modifier metal being effective for enhancing the corrosion resistance of said atomized powder or a sintered compact thereof.

2. The process of claim 1 wherein said modifier metal is niobium.

3. The process of claim 1 wherein said modifier metal is titanium.

4. The process of claim 1 wherein said modifier metal is tantalum.

5. The process of claim 1 wherein said modifier metal is present in an amount from about 0.01% to about 10% by weight of said powder.

6. A tin and carbon containing corrosion resistant atomized stainless steel powder characterized in that said atomized stainless steel powder contains;

0.01% to about 10% tin, at least about 0.05% carbon, 0.01% to about 10% of a modifier metal selected from the group consisting of niobium, titanium, tantalum, and mixtures thereof, and the balance an iron base stainless steel alloy.

7. The tin and carbon containing corrosion resistant atomized stainless steel powder of claim 6; wherein the level of tin is 0.01% to about 5.0% and the level of modifier metal is about 0.01% to about 5.0%.

8. A sintered compact of the powder of claim 6.

9. The sintered compact of claim 8 wherein the ratio of modifier metal to carbon is from about 1:1 to about 10:1.

* * * * *